US005181071A

United States Patent [19]

Nakajima et al.

[11] Patent Number: 5,181,071

[45] Date of Patent: Jan. 19, 1993

[54] APPARATUS FOR EVALUATING CHARACTERISTICS OF PHOTOSENSITIVE DRUM FOR ELECTROPHOTOGRAPHY

[75] Inventors: Satoshi Nakajima; Kouichi Mochizuki; Hiroki Kobayashi; Yuji Kohno, all of Kofu, Japan

[73] Assignees: Yamanashi Electronics Co., Ltd., Yamanashi; Shindengen Electric Manufacturing Co., Ltd., Tokyo, both of Japan

[21] Appl. No.: 801,663

[22] Filed: Dec. 2, 1991

[51] Int. Cl.[5] ..... G03G 21/00

[52] U.S. Cl. ..... 355/203; 355/200; 355/208; 355/211

[58] Field of Search ..... 355/203, 204, 205, 207, 355/208, 211, 200, 228, 232, 235, 229, 67–69, 71, 72

[56] References Cited

U.S. PATENT DOCUMENTS

| | | | |
|---|---|---|---|
| 3,578,862 | 5/1971 | Hudock | 355/104 |
| 4,176,943 | 12/1979 | Hasebe | 355/67 X |
| 4,348,099 | 9/1982 | Fantozzi | 355/208 |
| 4,771,339 | 9/1988 | Clinton | 358/296 |
| 4,988,188 | 1/1991 | Ohta | 355/67 X |

FOREIGN PATENT DOCUMENTS

| | | | |
|---|---|---|---|
| 0049364 | 3/1985 | Japan | 355/71 |
| 60-87379 | 5/1985 | Japan . | |
| 0052929 | 3/1987 | Japan . | |
| 63-182686 | 7/1988 | Japan . | |

*Primary Examiner*—A. T. Grimley
*Assistant Examiner*—Matthew S. Smith
*Attorney, Agent, or Firm*—Stevens, Davis, Miller & Mosher

[57] ABSTRACT

An apparatus for evaluating the characteristics of a photosensitive drum for use in electrophotography including a rotatable photosensitive drum having characteristics to be measured, a charging portion and an exposure light source portion and the like respectively secured to portions adjacent to the photosensitive drum. The surface potential of the photosensitive drum, which is generated due to operation of the charging portion and the exposure light source portion or the like, is measured by a potential measuring probe which is, together with the charged portion and the exposure light source portion and the like, secured adjacent to a position of the photosensitive drum, at which light is applied at the shortest distance from the exposure light source portion. The photosensitive drum is moved along its lengthwise direction so that the surface potential of the photosensitive drum is measured by the potential measuring probe.

5 Claims, 5 Drawing Sheets

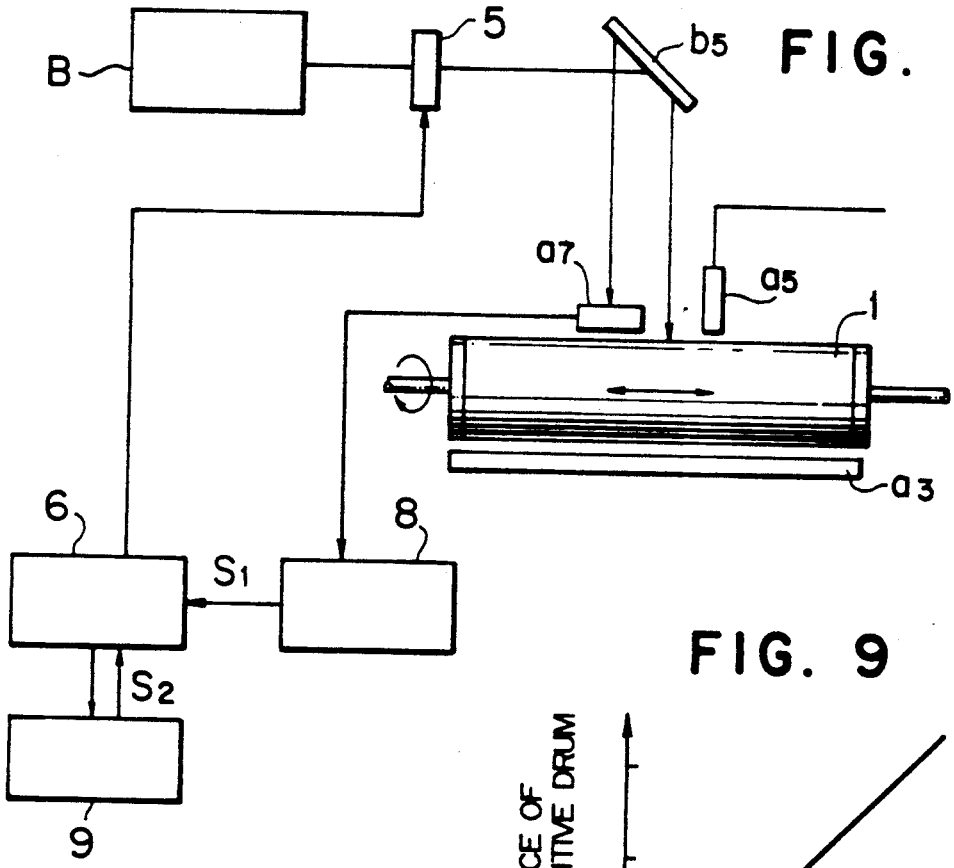
FIG. 8
FIG. 9
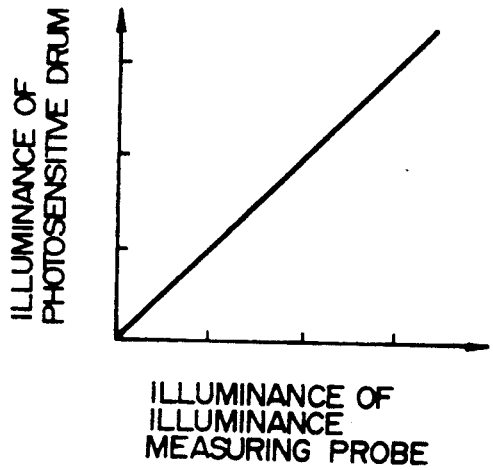
FIG. 10
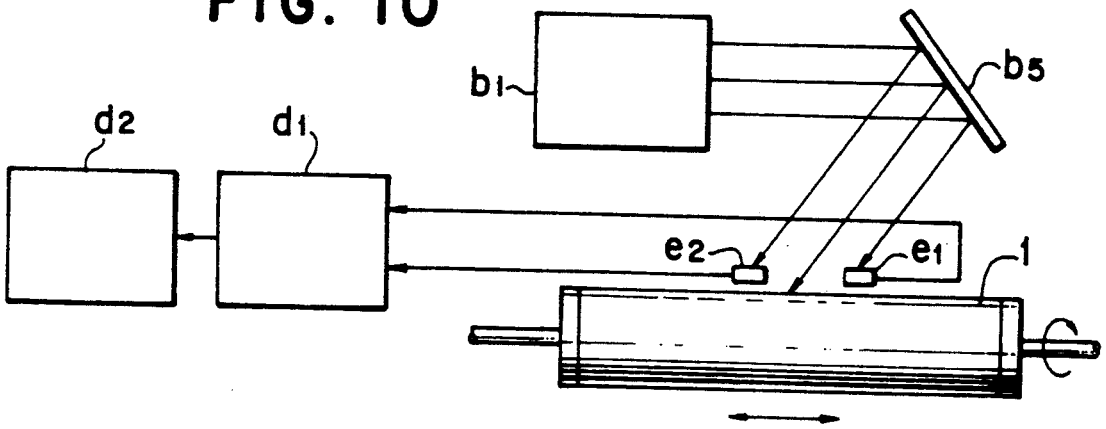

APPARATUS FOR EVALUATING CHARACTERISTICS OF PHOTOSENSITIVE DRUM FOR ELECTROPHOTOGRAPHY

BACKGROUND OF THE INVENTION

1. Field of the Invention

The present invention relates to an apparatus for evaluating the characteristics of a photosensitive drum for electrophotography, and, more particularly, to an apparatus, a structure and a method capable of improving the accuracy in evaluating the characteristics of the same.

2. Related Art Statement

When a photosensitive drum for use in electrophotography is delivered, a variety of characteristics such as the charge, the dark damping, the optical damping and the fatigue of the manufactured photosensitive drum must be measured to evaluate whether or not the characteristics of the manufactured photosensitive drum meet predetermined standard ranges. Accordingly, a characteristics evaluating apparatus has been used to evaluate the above-described characteristics in a sampling inspection manner.

A characteristics evaluating apparatus of the type described above has been composed of a process drive portion A, an exposure light source portion B, a control portion C, and an independent computer system portion D and the like. Furthermore, the above-described elements A, B, C and D respectively comprise:

The process drive portion A comprises a drive portion such as a motor for rotating a photosensitive member such as a photosensitive drum, a charging/discharging portion disposed to confront the surface of the photosensitive drum, and a charged potential measuring probe. The exposure light source B comprises an exposure light source, a light control diaphragm portion, a mirror and an exposure control portion. The control portion C comprises a control portion for controlling the rotation of the motor of the process drive portion A, a main power source portion, a high voltage power source portion for the charging operation, a measurement control portion and a lamp power source portion.

Furthermore, the computer system portion D has a function of transmitting, to the units, automatically setting outputs for setting exposure energy, the quantity of charge, the rotational and movement speed of the photosensitive member and the measurement position for measuring the surface potential. In addition, the computer system portion D has a function of subjecting the various characteristics obtained by the measurements and corresponding reference values to comparisons and transmitting and display, for example, the deviations of the measured values.

However, the above-described conventional characteristics evaluating apparatus suffers from a problem of an erroneous result in the potential measurement or another problem of scatter in measured values if, for example, the same measuring point is not measured even if the same photosensitive drum is measured.

The above-described characteristics evaluating apparatus according to the conventional technology is arranged in such a manner that the process drive portion A, the exposure light source portion B and the control portion C are accommodated in the same space in a case formed into a dark box. Therefore, although an adverse influence of external light upon the exposure of the photosensitive drum can be eliminated, another adverse influence of light leaked from the exposure light source portion upon the photosensitive drum cannot be eliminated. What is even worse, the measured values of the surface potential will easily scatter because the quantity of leaked light can be changed depending upon the set condition of the exposure light quantity. Furthermore, the measured values scatter because the quantity of leaked light is changed depending upon the employed characteristics evaluating apparatus. In addition, the temperature in the case rises with time due to heat generated in the exposure light source portion B and that generated in the light source portion of the control portion C. Therefore, the characteristics cannot easily be evaluated under a constant temperature condition and the scatter in the measured values cannot be prevented.

Then, the process drive portion A and the exposure light source portion B of the conventional characteristics evaluating apparatus will now be described with reference to FIG. 1.

The process drive portion A comprises a supporting frame a1 to which the photosensitive drum 1, the characteristics of which must be measured, is fastened, a rotation drive source a2 for rotating the photosensitive drum 1, a charging portion a3 for charging the entire surface of the photosensitive drum 1 by a corona discharging wire disposed to confront the overall length of the surface of the fastened photosensitive drum, a discharging portion a4 for discharging it after the measurement has been completed, a potential measuring probe a5, a screw shaft a5′ for moving the potential measuring probe a5 in the lengthwise direction of the photosensitive drum 1 for the overall length of the same, a supporting member a5″ screwed to it, a drive source a6 for rotating the screw shaft a5′ and an illuminance measuring probe a7 secured adjacent to the portion of the surface of the photosensitive drum 1 to which light is applied in such a manner that the illuminance measuring probe a7 confronts the photosensitive drum 1.

The exposure light source portion B, for example, comprises a light source b1, a monochrometer (spectrometer) b3, a light control diaphragm b4 and a reflecting mirror b5.

The above-described characteristics evaluating apparatus according to the conventional technology evaluates the electrostatic characteristics in the lengthwise direction of the photosensitive drum 1 in such a manner that the photosensitive drum 1 is rotated and the charging portion a: and the exposure light source portion B secured adjacent to the photosensitive drum 1 charge and expose the entire surface of the photosensitive drum 1. Then, the potential measuring probe a5 is moved in the lengthwise direction of the photosensitive drum 1 at proper speed to measure the surface potential so that the measured value is subjected to a comparison with a reference value stored in the computer system portion and thus the evaluation is made.

However, since the light incidental position from the exposure light source portion B upon the photosensitive drum 1 is fixed, the exposure light quantity applied to the photosensitive drum 1 cannot easily be equalled on the entire surface in the lengthwise direction of the photosensitive drum 1. For example, in a case where light is made incident upon the central portion of the photosensitive drum, the surface of the central portion of the photosensitive drum 1 positioned at the shortest distance from the exposure light source portion B as designated by an alternate long and short dash line of FIG. 2 displays the largest exposure light quantity. The same becomes smaller and uneven in inverse proportion to the sideward distances.

Therefore, the surface potential of the exposed photosensitive drum becomes uneven in such a manner that the same is the lowest in the central portion and is enlarged in proportion to the sideward distance from the central portion as designated by a dashed line of FIG. 2. Therefore, the detection output of the potential obtained by the potential measuring probe a5 arranged to be movable in the overall length of the photosensitive drum 1 is evaluation data including the potential change due to the above-described reasons, causing an error to take place in the evaluation.

In order to make an accurate evaluation by using the characteristics evaluating apparatus, charging of the photosensitive drum must be always performed at a longitudinally even and predetermined value. Furthermore, a predetermined quantity of light must always be applied from the exposure light source portion B to surface of the photosensitive drum 1 during the measurement operation.

Accordingly, in order to maintain a predetermined light quantity, the conventional technology has employed a method, as schematically shown in FIG. 3, arranged in such a manner that light emitted from the exposure light source portion B is applied to the surface of the photosensitive drum 1 via a shutter 5 and the degree of opening of the shutter 5 is controlled by, for example, a set output supplied from the computer system D.

However, the above-described method encounters a problem in that the quantity of light applied to the photosensitive drum cannot be made uniform because the degree of opening of the shutter 5 is made to be a constant degree regardless of the change in the light quantity due to deterioration in, for example, the exposure light source portion B. What is even worse, another problem takes place in that the undesirable change in the light quantity cannot immediately be modified if the same is changed during the exposure operation due to the change in the voltage to be supplied to the exposure light source portion B and thereby generation of an error in the evaluation result cannot be prevented.

SUMMARY OF THE INVENTION

An object of the present invention is to provide an arrangement and structure capable of overcoming the above-described problems experienced with the conventional apparatus and thereby capable of improving the accuracy in characteristics evaluation.

Another object of the present invention is to provide an apparatus capable of overcoming the above-described conventional problem of an error in the measured potential which can be taken place in the lengthwise direction of the photosensitive drum and thereby capable of accurately evaluating the characteristics.

Another object of the present invention is to provide a means capable of maintaining a predetermined light quantity to follow the change in the light quantity due to the deterioration in the light source or the like and as well as capable of immediately controlling the exposure light quantity applied to the photosensitive drum even if the light quantity is changed during the exposure operation and to improve the characteristics evaluating accuracy.

Another object of the present invention is to provide a means capable of easily detecting the angular deviation of the reflecting mirror and as well as easily correcting the same.

According to one aspect to the present invention, the internal accommodating space of a case is optically divided into three sections in such a manner that a control portion is accommodated in the lowermost portion, a process drive portion is accommodated in the intermediate portion and an exposure light source portion is accommodated in the uppermost portion so that introduction of leaked light into the process drive portion is prevented. Furthermore, an air transmission device and an exhaust device are provided for the exposure light source portion and the control portion which respectively generate large heat so that the heat is exhausted. In addition, air in the portion in the process drive portion is indirectly exhausted by the above-described devices. Therefore, the problems experienced with the above-described conventional apparatus can be overcome by preventing the optical and thermal interference between the provided units.

According to a second aspect of the present invention, a potential measuring probe is fixed adjacent to a portion of the photosensitive drum to which the largest quantity of light is applied and the photosensitive drum is moved in the lengthwise direction of the photosensitive drum while rotating the photosensitive drum so that the problems experienced with the above-described conventional apparatus are overcome.

According to a third aspect of the present invention, an illuminance measuring probe is disposed in the vicinity of the photosensitive drum and a control portion is provided for subjecting the detection output from the illuminance measuring probe and a set value of the exposure light quantity to a comparison and controlling a shutter which shuts/passes the light irradiation from the exposure light source to the photosensitive drum in such a manner that the difference between the detection output and the set value is always made to be zero so that the problems experienced with the above-described conventional apparatus are overcome.

According to a fourth aspect of the present invention, an illuminance measuring probe for supervising the quantity of light applied to the surface of a photosensitive drum comprises a first illuminance measuring probe and a second illuminance measuring probe, the same quantity of light is applied from a reflecting mirror to the first illuminance measuring probe and a second illuminance measuring probe, a fact that the quantity of light applied to the first illuminance measuring probe and that applied to the second illuminance measuring probe become different if the angle of the reflecting mirror is changed is utilized to control the change in the angle of the reflecting mirror.

Other and further objects, features and advantages of the invention will be more fully apparent from the following description.

BRIEF DESCRIPTION OF THE DRAWINGS

FIG. 8 is a schematic structural view which illustrates a third embodiment of the present invention;

FIG. 9 is a graph which illustrates the relationship between the illuminance of the illuminance measuring probe and that of the photosensitive drum measured by the apparatus shown in FIG. 8; and FIG. 10 illustrates a fourth embodiment of the present invention.

DESCRIPTION OF THE PREFERRED EMBODIMENTS

Figure 4:
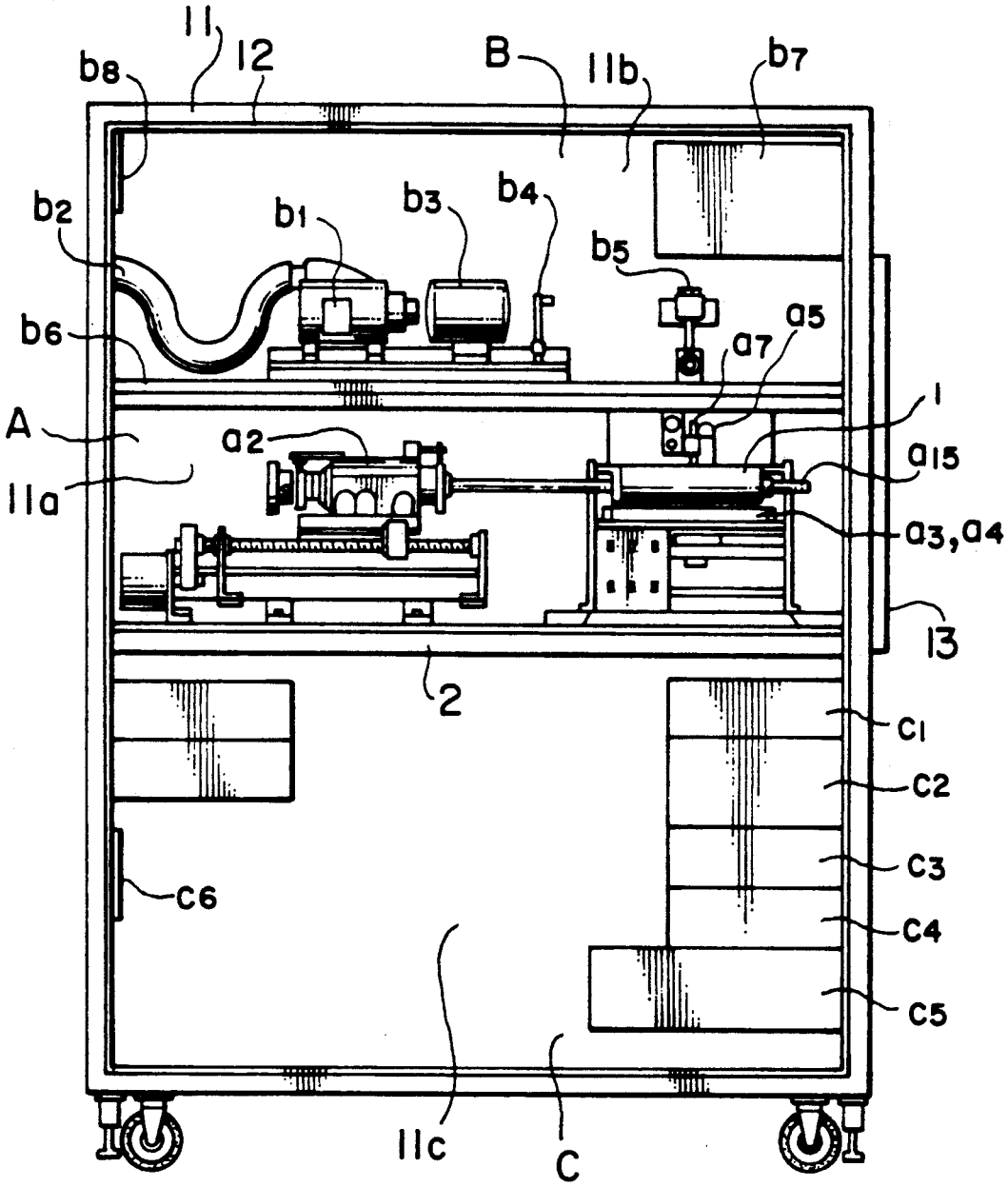
FIG. 4 is a side elevational cross sectional view which illustrates the structure and arrangement of elements of a first embodiment of a characteristics evaluating apparatus according to the present invention.
Figure 5:
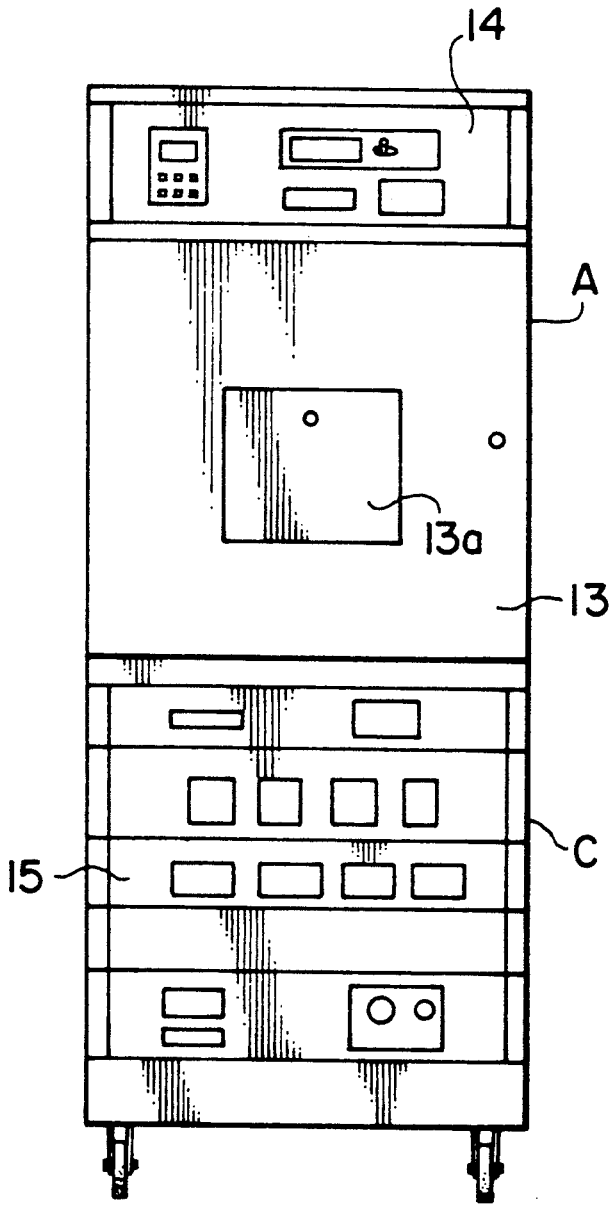
FIG. 5 is a front elevational view of FIG. 4.

FIGS. 4 and 5 respectively are side elevational cross sectional view and a front elevational cross sectional view which illustrate the structure of a first embodiment of a characteristics evaluating apparatus according to the present invention. Referring to FIG. 4, reference numeral 11 illustrates a case which is covered by delustered partition plates 12 (which may possess heat insulating characteristics) placed on the upper and the lower portions, the right and the left portions and the rear portion. As a result, an accommodating space 11*c* for accommodating a control unit is created in the lowest portion which has the opened front portion, an accommodating space 11*a* for accommodating a process drive portion is created in the intermediate portion and an accommodating space 11*b* for accommodating an exposure light source portion is created in the uppermost portion. Symbol A represents a process drive portion having a drive transmission shaft a15 for fastening a photosensitive drum 1, a charging/discharging portion 33, 24, a potential measuring probe a5, an illuminance measuring probe a7 and a photosensitive drum rotating drive source a2. The above-described elements are respectively secured to the upper surface of a base plate 2 at predetermined positions so that they are accommodated in the accommodating space 11*a*.

Symbol B represents an exposure light source portion having an exposure light source b1 and an exhaust pipe b2 which is connected to the outside by a pipe in order to shut external light. Symbol b3 represents a monochrometer, b4 represents a light control diaphragm and b5 represents a reflecting mirror each of which is fastened on the upper surface of a base plate bs so that they are accommodated in the above-described accommodating space 11*b*. As a result, the photosensitive drum 1 is irradiated with light via a light irradiating hole (omitted from illustration) formed in the partition plate 12 and the base plate b6. Symbol b represents an exposure control unit and bs represents an air transmission device. Reference numeral 13 represents an opening/closing door fastened to the front opened portion of the accommodating space 11*a* so that the process drive portion A and the exposure light source portion B dan be inspected. The opening/closing door 13 has a small door 13*a* at a position corresponding to the photosensitive drum 1 of the process drive portion A, the small door 13*a* being provided so as to enable loading/unloading of the photosensitive drum 1. Reference numeral 14 represents an upper front panel screwed to, for example, the case 11 so that the above-described exposure control unit b7 and various meters and switches are fastened to the front panel 14.

Symbol C represents a control portion having a measurement control unit c1, a high voltage main power source unit c2, a power source unit c3 for the light source, a motor drive unit c4 and a high voltage power source for the portion to be charged. The above-described elements are fastened to a plurality of front panels 15 which closes the front opening portion of the case 11 and which is, for example, screwed there. Symbol c6 represents a exhaust device which is fastened to the rear panel of the case 11.

According to the first embodiment of the present invention, the process drive portion A, the exposure light source portion B and the control portion C and the like, which are, according to the conventional structure, accommodated in the same space in the case, are respectively independently accommodated in three spaces of the internal space of the case created by optically sectioning the above-described internal space so that the influence of external light and that of light leaked from the exposure light source are prevented. Therefore, an effect can be obtained in overcoming the conventional problem of the deterioration in the accuracy in the measurement of the photosensitive drum of the process drive portion A due to the influence of light leaked from the exposure light source portion B. Furthermore, heat of the exposure light source portion B is exhausted by the air transmission device b8 and the exhaust pipe b2. In addition, an air flow is generated by the air transmission device bs disposed in the exposure light source portion B and the exhaust device c6 disposed in the control portion C, the air flow being generated to pass through the exposure light source portion B, the process drive portion A and the control portion C via a light injection hole (omitted from illustration) for use in the exposure operation. As a result, heat generated can be discharged outside. Therefore, the influence of heat generated in the exposure light source portion B and that generated in the control portion C upon the photosensitive drum can be substantially prevented. As a result, the characteristics can be evaluated under a constant temperature condition and thereby the problems experienced with the conventional apparatus can be overcome.

According to the conventional apparatus, there arises another problem in that the life of the apparatus is deteriorated because the apparatus is filled with oxidative ozone ($O_3$) generated due to the corona discharge for use in the charging operation and thereby the apparatus is oxidized. However, according to the present invention, air can be transmitted by the air transmission device bs disposed in the exposure light source portion B and the exhaust device c6 disposed in the control portion C. Therefore, air can be discharged outside through the light injection hole for use in the exposure operation formed between the process drive portion A and the exposure light source portion B, causing an effect to be obtained in that the problem of the corrosion, which can be generated by generated ozone, can be overcome.

Furthermore, according to the present invention, the process drive portion is accommodated in the intermediate accommodating space in the case. Therefore, an effect can be obtained in that the door through which the photosensitive drum is loaded/unloaded can be disposed at a position which is suitable for an operator to operate it.

Figure 1:
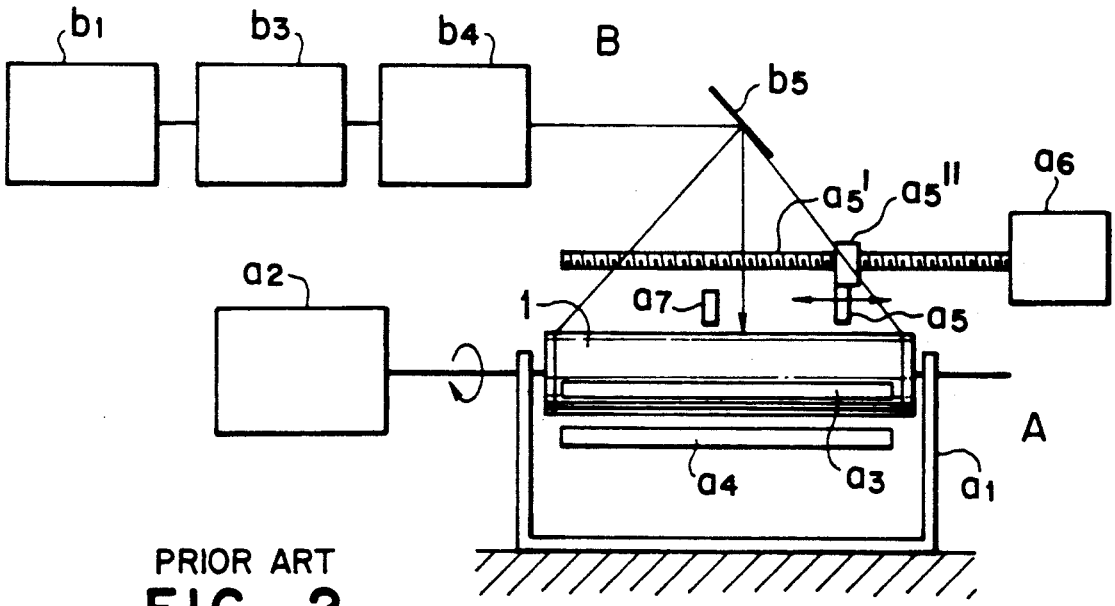
PRIOR ART FIG. 1
FIG. 1 illustrates a process drive portion A and an exposure light source portion B of a conventional characteristics evaluating apparatus.
Figure 6:
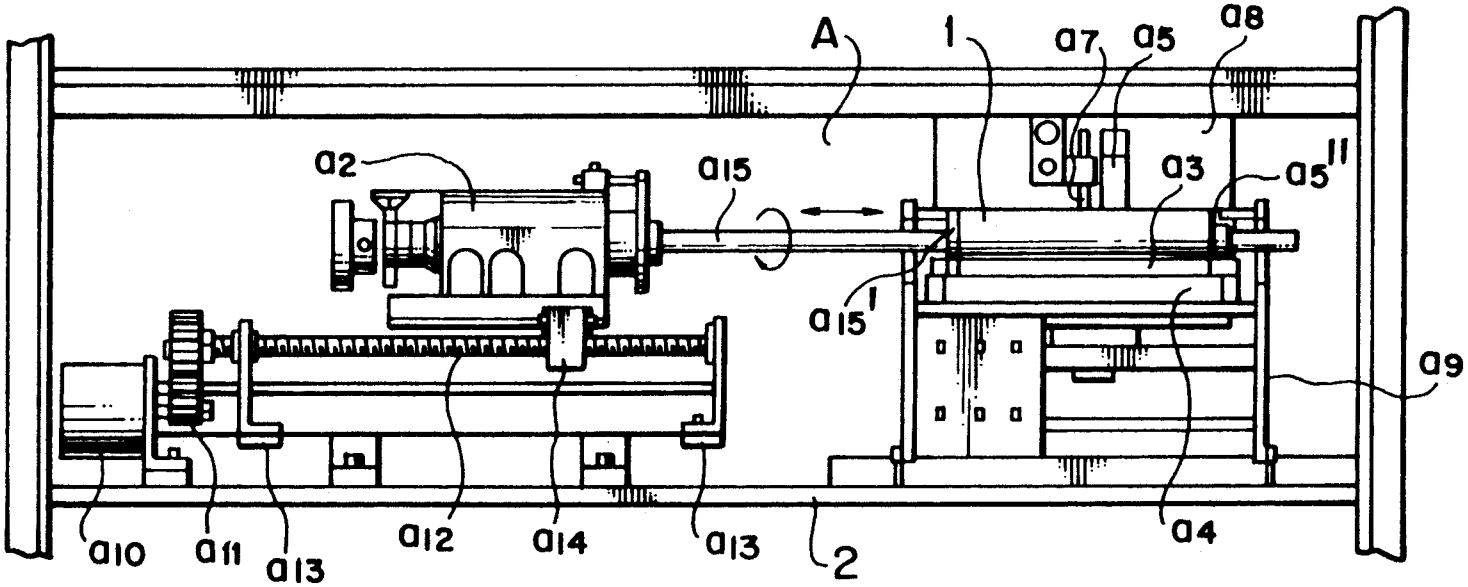
FIG. 6 is a schematic structural view which illustrates a second embodiment of the present invention.

FIG. 6 is schematic structural view which illustrates a second embodiment of the present invention, wherein the elements given the same reference numerals as those shown in FIG. 1 are the same elements. Referring to FIG. 6, symbol A represents a process drive portion which has a photosensitive drum 1 the characteristics of which must be measured, a charging portion a: and a discharging portion a4. The above-described elements a3 and a4 are disposed to confront the overall length of the photosensitive drum 1. Symbol a5 represents a potential measuring probe and a7 represents an illuminance measuring probe. The potential measuring probe a5 and the illuminance measuring probe a7 are secured to the surface of the base plate 2 at a position adjacent to a position at which the largest quantity of light is applied to the photosensitive drum 1, the potential measuring probe a5 and the illuminance measuring probe a7 being secured there by using a fixing plate as and a fixing frame a9 while maintaining a predetermined confronting position with respect to the photosensitive drum 1.

Symbol a10 represents a forward/reverse rotation selectable drive source for moving the photosensitive drum 1 in a direction of the X-Y axis, the forward-/reverse rotation selectable drive source a10 being secured to the base plate 2. Symbol a11 represents a drive gear, a12 represents a screw shaft and a13 represents a screw shaft supporting member which is secured to the base plate 2. Symbol a2 represents a drive source for rotating the photosensitive drum 1 and a14 represents a supporting member for supporting the same and which is engaged with the screw shaft a12. Symbol a15 represents a power transmission shaft for fastening the photo sensitive drum 1. The photosensitive drum 1 is fastened while maintaining the coaxiality with the power transmission shaft a15, for example, in such a manner that the power transmission shaft a15 is inserted into the photosensitive drum 1 is inserted while utilizing the internal space of the photosensitive drum 1 until a flange a15' an end portion of which is secured to the power transmission shaft a15 is press-fit. Furthermore, a ring flange a15" is fitted to another end portion with a nut to be tightened. As a result, when the forward/reverse rotation selectable drive source a10 and the rotation drive source a2 are rotated, the screw shaft a12 is rotated via the drive gear a11. Therefore, the supporting member a14 for supporting the rotation drive source a2 is moved in the lengthwise direction of the screw shaft a12. As a result, the photosensitive drum 1 fastened to the power transmission shaft a15 is moved in the direction of the X-Y axis with respect to the positions potential measuring probe a5 and the like secured as described above, the photosensitive drum 1 being rotated during the above-described movement motion.

Figure 7:
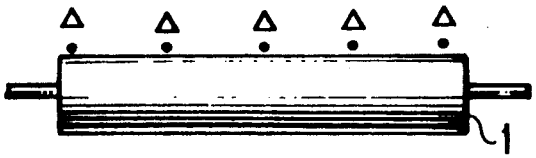
FIG. 7 illustrates the state of potentials on the surface of the photosensitive drum measured by the apparatus shown in FIG. 6.

According to the second embodiment of the present invention, the potential measuring probe a5 always measures the potential of portions given mark • at which the largest quantity of light is applied as designated by triangle marks as shown in FIG. 7. Therefore, if the quantity of exposure light at which the largest quantity of light is applied is controlled to display a constant value by using the detection output from the illuminance measuring probe a7 the error in the measured potential can be reduced. Therefore, the accuracy in evaluating the characteristics can be improved according to the present invention.

Figure 2:
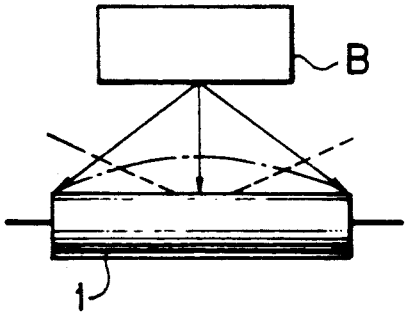
PRIOR ART FIG. 2
FIG. 2 illustrates scatter in the exposure light quantity and the potential on the surface of a photosensitive drum of the apparatus shown in FIG. 1.
Figure 3:
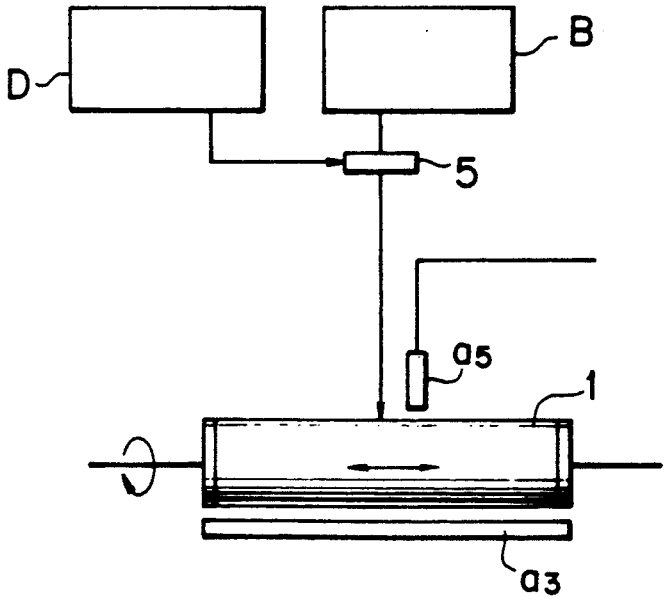
PRIOR ART FIG. 3
FIG. 3 illustrates a method of adjusting the exposure light quantity according to the conventional technology.

FIG. 8 is a schematic structural view which illustrates a third embodiment of the present invention, where the same reference numerals as those shown in FIGS. 1 to 3 represent the same elements. The present invention is characterized by:

(1) Light emitted from the exposure light source B is applied to the photosensitive drum 1 by using the reflecting mirror b5 serving as a light irradiating portion. Furthermore, the illuminance measuring probe a7 is disposed in the vicinity of the photosensitive drum 1 at a position near a portion to which the most intense light is applied, that is, a portion which is most adjacent to the light source B. In addition, for example, the angle of the reflecting mirror b5 is adjusted so that the illuminance of the photosensitive drum 1 and that of the illuminance measuring probe a7 is made to be, for example, 1:1 as shown in FIG. 9.

(2) A comparison is made between output S1 from an illuminance meter 8 and a set value S2 supplied from, for example, a computer system portion 9 in such a manner that they are supplied to a control unit 6. Furthermore, the degree of opening of a shutter 5 is controlled in such a manner that the difference in the above-described two values S1 and S2 is always zero.

According to the third embodiment of the present invention, the ratio of the illuminance of the photosensitive drum 1 and that of the illuminance measuring probe a7 can easily be made to be 1:1 by adjusting the angle of the reflecting mirror b5. Therefore, the output from the illuminance meter 8 to which the input of the illuminance measuring probe a7 is connected can be made to correspond to the exposure light quantity applied to the photosensitive drum 1 at a ratio of 1:1.

As a result, the shutter 5, the degree of opening of which is controlled in such a manner that the comparative output between the output S1 from the illuminance meter 8 and the set value S2 is always zero, is able to always adjust the exposure light quantity applied to the photosensitive drum 1 regardless of the change in the light quantity due to deterioration in the exposure light source B.

Furthermore, by properly determining the responsibility of the system for controlling the shutter 5, the adjustment operation can immediately be commenced even if the light quantity is changed due to the deterioration in the exposure light source B during the exposure operation. Therefore, a predetermined value of the exposure light quantity can be maintained during the exposure operation, causing an effect to be obtained in that all of the above-described problems experienced with the conventional technology can be overcome. Although the above-described embodiment is arranged in such manner that light is applied to the photosensitive drum and the illuminance measuring probe by using the reflecting mirror which serves as the light irradiating portion, an optical fiber may be used to be applied at a ratio of 1:1.

According to the above-described third embodiment of the present invention, if the angle of the reflecting mirror b: is out of order at the time of inspecting the exposure light source portion B or an undesirable application of external force, for example, vibrations, the quantity of light applied to the illuminance measuring probe a7 will be changed. Therefore, the determined conditions about the light quantity applied to the photosensitive drum 1 and the illuminance measuring probe a7 is deviated. In this case, the supervision of the quantity of light applied to the photosensitive drum 1 cannot be performed depending upon the detection output from the illuminance measuring probe a7. What is even worse, if the degree of the deviation of the angle of the reflecting mirror b: is too small, it cannot be visually checked. Therefore, the difference in the quantity of applied light cannot easily be detected. As a result, there is a risk in that the measurement operation is erroneously performed because the angle change cannot be detected.

Accordingly, according to a fourth embodiment of the present invention, there is provided a means capable of easily detecting and correcting the angular deviation of the reflecting mirror.

FIG. 10 illustrates a fourth embodiment of the present invention which is characterized by:

(1) A first and a second illuminance measuring probes e1 and e2 are disposed in such a manner that a portion of the photosensitive drum 1, which is irradiated with most intense light, is positioned between the two illuminance measuring probes e1 and e2. Furthermore, the same quantity as that applied to the photosensitive drum 1 is applied to each of the two illuminance measuring probes e1 and e2. Thus, the angular deviation of the reflecting mirror b5 can be detected in accordance with the difference in the detected output between the first illuminance measuring probe e1 and the second illuminance measuring probe e2 which can be taken place if the angle of the reflecting mirror b5 is changed.

According to the above-described fourth embodiment of the present invention, the output denoting the result of the detections performed by the first and the second illuminance measuring probes e1 and e2 are the same. However, if the angle of the reflecting mirror b5 is out of order, the quantity of light applied to the first illuminance measuring probe e1 and that applied to the second illuminance measuring probe e2 become different. Therefore, by displaying the detection outputs from the first and the second illuminance measuring probes e1 and e2 or by calculating the difference by a calculating portion d1 as shown in FIG. 10 and displaying it by a display portion dz, the generation of the angular deviation of the reflecting mirror b5 can easily be detected from the display.

Even if the angular deviation of the reflecting mirror b: is detected, it can easily be corrected by adjusting the angle of the reflecting mirror b5 in such a manner that the detection outputs from the first and the second illuminance measuring probes e1 and e2 become the same, that is, the difference to be made to be zero.

Although the above-described four embodiments can be respectively independently applied to a characteristics evaluation apparatus, they may be arbitrarily combined so as to be applied to the characteristics evaluation apparatus.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. An apparatus for use in electrophotography, said apparatus comprising:

a rotatable photosensitive drum having characteristics to be measured;

a charging portion, an exposure light source portion and the like respectively secured adjacent to said photosensitive drum and arranged such that a surface potential of said drum, which is generated due to operation of the charging portion and the exposure light source portion and the like, is measured by a potential measuring probe which is fixed adjacent to a position of said photosensitive drum at which light irradiated onto said photosensitive drum by said exposure light source portion travels over a shortest distance, said drum being movable in a lengthwise direction of said photosensitive drum so that the surface potential of said photosensitive drum is measured by said potential measuring probe.

2. An apparatus according to claim 1, wherein an illuminance measuring probe is disposed in the vicinity of said photosensitive drum and a control portion is provided for subjecting the detection output from said illuminance measuring probe and a set value of the exposure light quantity to a comparison and controlling a shutter which shuts/passes the light irradiation from said exposure light source to said photosensitive drum such that the difference between said detection output and said set value is always made to be zero.

3. An apparatus according to claim 1, wherein a first illuminance measuring probe and a second illuminance measuring probe for supervising the quantity of light applied to the surface of said photosensitive drum are provided, the same quantity of light is applied from a reflecting mirror to said first illuminance measuring probe and a second illuminance measuring probe and means is provided which utilizes a fact that the quantity of light applied to said first illuminance measuring probe and that applied to said second illuminance measuring probe become different if the angle of said reflecting mirror is changed to control the change in the angle of said reflecting mirror.

4. An exposure light quantity supervising method adaptable to an apparatus for evaluating characteristics of a photosensitive drum for use in electrophotography arranged such that light emitted from an exposure light source and reflected and deflected by a reflecting mirror is applied to a photosensitive drum and illuminance of said photosensitive drum is detected by an illuminance measuring probe to supervise the quantity of light applied to the surface of said photosensitive drum in accordance with the detection output from said illuminance measuring probe, said exposure light quantity supervising method being adaptable to an apparatus for evaluating characteristics of a photosensitive drum for use in electrophotography, said method comprising the steps of:

providing a second illuminance measuring probe in addition to said first illuminance measuring probe;

applying the same quantity of light to said first and second illuminance measuring probes via said reflecting mirror; and detecting the change in the angle of said reflecting mirror the above-described accommodating space lb. As a result, by utilizing a fact that the quantity of light applied to said first illuminance measuring probe and that applied to said second illuminance measuring probe become different from each other if said angle of said reflecting mirror is changed.

5. An apparatus for use in electrophotography, said apparatus comprising:

a process drive portion;

an exposure light source portion;

a control portion; and a case which accommodates said elements in a same shielding space thereof, wherein said space in said case is divided into three sections in order to prevent introduction of external light and light transmitted from said exposure light source portion into at least said process drive portion such that a lowermost accommodating space of said three sections accommodates said control portion, an intermediate accommodating space of said three sections accommodates said process drive portion and an uppermost accommodating space of said three sections accommodates said exposure light source portion;

an air transmission device and an exhaust pipe opened to the outside are provided for said exposure light source portion; and an exhaust device is provided for said control portion, wherein said process drive portion has a rotatable photosensitive drum having characteristics to be measured, and a charging portion and the like secured adjacent to said photosensitive drum and a potential measuring probe for measuring a surface potential, generated due to charge exposure, of said photosensitive drum and said potential measuring probe being fixed adjacent to a position of said photosensitive drum at which light irradiated onto said photosensitive drum by said exposure light source portion travels over a shortest distance, said drum being movable in a lengthwise direction of said photosensitive drum so that the surface potential of said photosensitive drum is measured by said potential measuring probe.

* * * * *